United States Patent [19]

Warburton

[11] Patent Number: 5,046,659

[45] Date of Patent: Sep. 10, 1991

[54] LATCHING STRUCTURE FOR FOOD CONTAINER

[75] Inventor: Richard T. Warburton, Canandaigua, N.Y.

[73] Assignee: Mobil Oil Corporation, Fairfax, Va.

[21] Appl. No.: 611,576

[22] Filed: Nov. 13, 1990

[51] Int. Cl.[5] ..... B65D 1/22

[52] U.S. Cl. ..... 229/2.500; 220/4.22; 220/4.23; 220/4.24; 220/339

[58] Field of Search ..... 229/2.5 R, 2.5 EC; 220/4.1, 4.2, 4.3, 4.21, 4.22, 4.23, 4.24, 306, 339, 315, 352

[56] References Cited

U.S. PATENT DOCUMENTS

| | | | |
|---|---|---|---|
| 2,706,065 | 4/1955 | Stone | 220/4.21 |
| 3,149,747 | 9/1964 | Burgess | 220/4.21 |
| 3,234,077 | 2/1966 | Reifers et al. | 229/2.5 EC |
| 3,565,146 | 2/1971 | Arnolds | 220/4.23 |
| 3,771,712 | 11/1973 | Richards | 229/2.5 EC |
| 4,030,850 | 6/1977 | Hyde | 220/306 |
| 4,193,496 | 3/1980 | Barratt | 206/380 |
| 4,333,580 | 6/1982 | Sweigart, Jr. | 220/4.21 |
| 4,512,474 | 4/1985 | Harding | 220/4.23 |
| 4,576,330 | 3/1986 | Schepp | 229/44 |

FOREIGN PATENT DOCUMENTS

| | | | |
|---|---|---|---|
| 1117491 | 2/1982 | Canada . | |
| 1418897 | 12/1974 | United Kingdom . | |
| 1602694 | 11/1981 | United Kingdom | 220/4.24 |
| 2118142 | 10/1983 | United Kingdom | 229/2.5 R |

*Primary Examiner*—Stephen P. Garbe
*Assistant Examiner*—Christopher McDonald
*Attorney, Agent, or Firm*—Alexander J. McKillop; Charles J. Speciale

[57] ABSTRACT

Latching structure for thermoformed plastic containers for food and the like wherein the lid and base of the containers are each provided with mating male and female elongated elements where the locking takes place at the end of the elongated elements rather than along the sides of these elements.

12 Claims, 7 Drawing Sheets

LATCHING STRUCTURE FOR FOOD CONTAINER

BACKGROUND OF THE INVENTION

The present invention relates to improvements in thermoformed plastic containers for food or other articles and particularly to latching structure for holding the lid and base of the container in closed condition.

Containers for food or other articles thermoformed from plastic material normally comprise a lid and base which may be hinged to each other or may be separate parts. In order to hold the lid and base of the container in closed condition, it is necessary that the lid and base have latching structure which can be manually opened and closed with relative ease. However, the structure should be capable of locking the container in closed condition to avoid accidental opening.

Various types of latching or locking structures have been proposed in the past. For example, cylindrical male and female locking elements have been proposed as disclosed in U.S. Pat. No. 4,576,330. Elongated rib structures comprising cooperating male and female elements have been proposed as disclosed in British Patent Specification 1,418,897 and in Canadian Patent 1,117,491. In the prior elongated rib structure locking elements the locking action has taken place on the long sides of the ribs. This required that the ribs be located in such a position on the container that both sides of the ribs are engageable by the cooperating male and female elements to provide the locking action.

It would be desirable to provide mating male and female rib elements where the locking takes place at the end of the ribs rather than along the sides of the ribs. This permits the latching structure to be located at various locations on the container and also provides for a more positive latching action while permitting ease of manual operation in opening and closing the latching structure on the container.

SUMMARY OF THE INVENTION

It is an object of the present invention to overcome the deficiencies of the prior art in providing a latching structure for a container which is easy to operate in opening and closing the latching structure of the container.

In accordance with the present invention there is provided a container for food or other articles comprising a lid having a horizontal flange extending around the periphery thereof and a base having a horizontal flange extending around the periphery thereof adapted for engagement with the horizontal flange of the lid when the container is in closed condition. Latching structure is provided for latching the lid to the base. The latching structure includes at least one substantially rectangular male rib depending from the horizontal flange of the lid, the opposite ends of the rib having outwardly extending shoulder structure and the sides of the rib being substantially straight. At least one substantially rectangular female recess is located in the flange of the base and dimensioned to receive a cooperating male rib in the lid. The opposite ends of the female recess have inwardly extending shoulder structure adopted to mate with the outwardly extending shoulder structure of the male rib in the lid and the sides of the female recess are substantially straight. The ends of the male rib and the ends of the female recess are constructed and arranged to deflect with respect to each other so that when the male rib is pressed into the female recess the shoulder structure on the male will snap into position beneath the shoulder structure in the female recess and interlock therewith to latch the lid securely to the base.

In accordance with another aspect of the invention the container comprises a lid and base of identical construction which are interchangeable with one another and wherein latching structure is provided on opposite sides of the interchangeable lid and base.

For further objects and advantages of the present invention reference may be had to the following description and claims and from the accompanying drawing.

DETAILED DESCRIPTION OF THE PREFERRED EMBODIMENT

Figure 1:
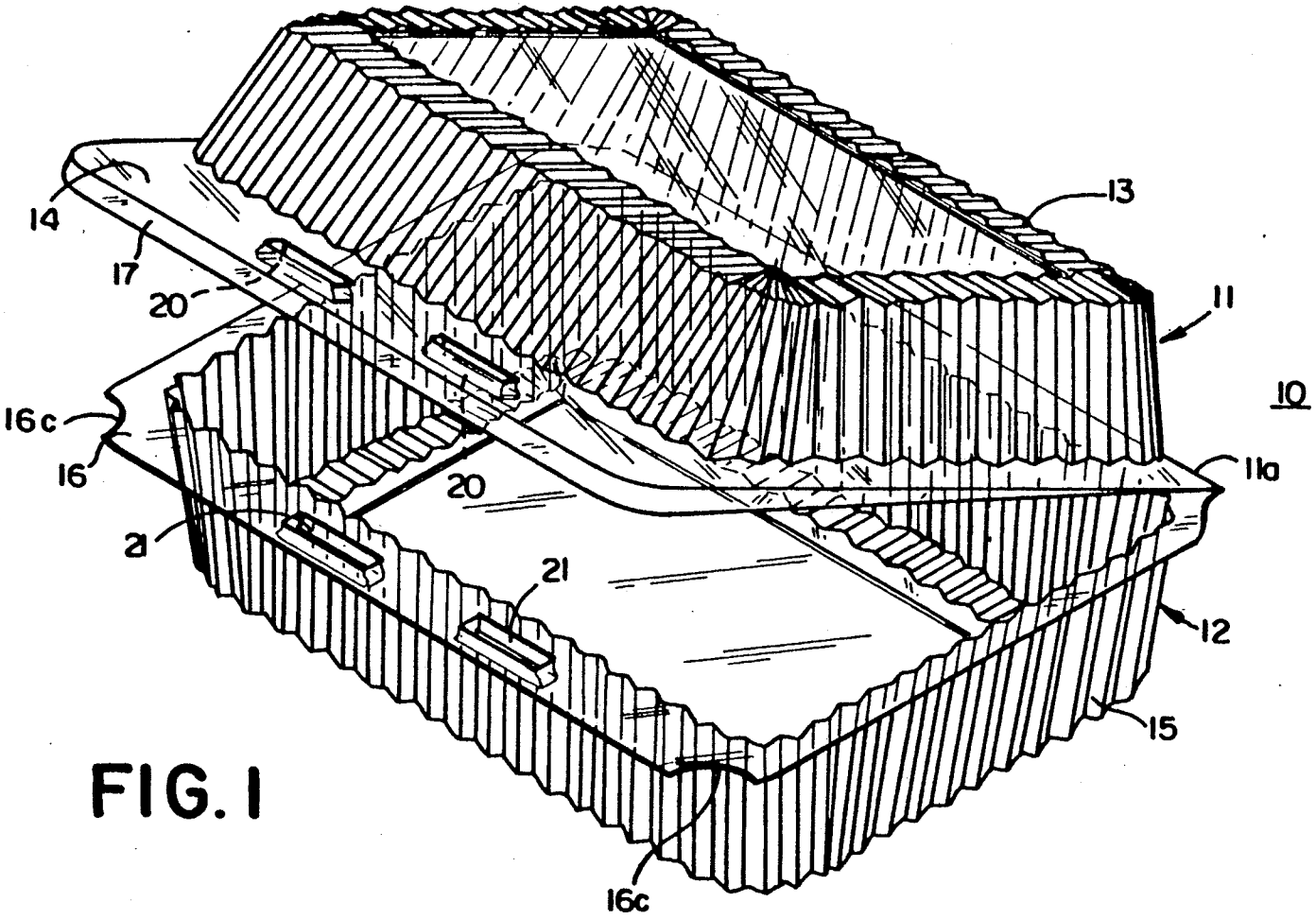
FIG. 1 is a perspective view of a container for food or other articles embodying the present invention showing a lid hinged to a base and latching structure for latching the lid to the base in closed position.
Figure 2:
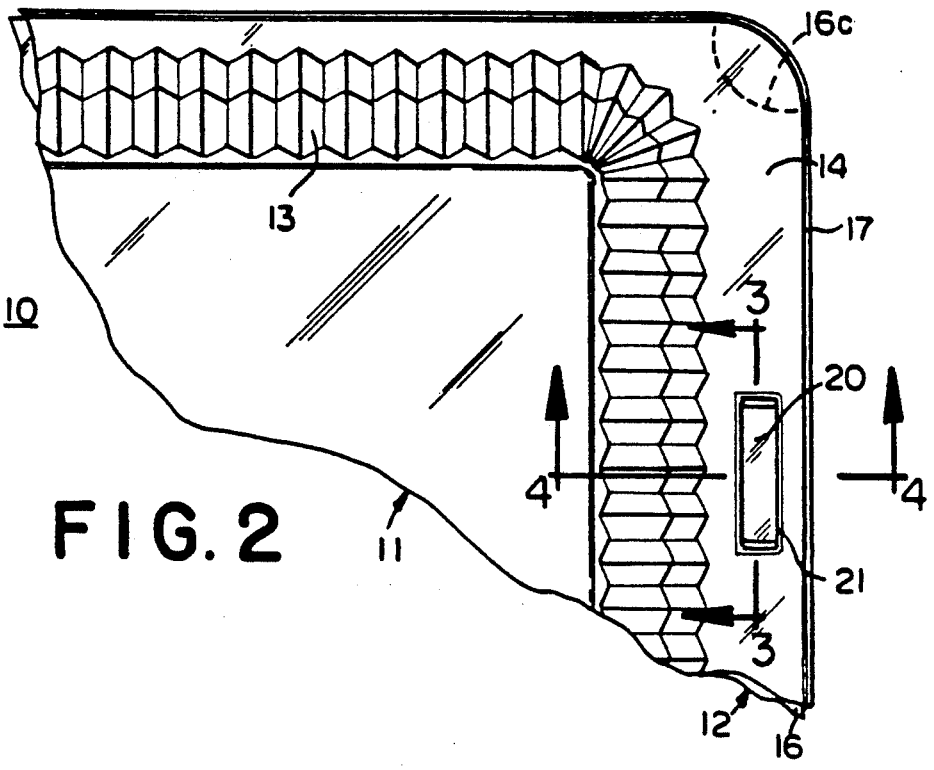
FIG. 2 is a fractional plan view of one corner of the container shown in FIG. 1 with the container in closed condition.

Referring now to the drawings, there is shown in FIG. 1 a plastic container 10 embodying the present invention. The container 10 is designed to be thermoformed from a suitable plastic material. One clear plastic material which is particularly suitable is oriented polystyrene (O.P.S.). Of course, other thermoformed plastic materials may be used depending upon the end use of the containers. The container 10 is particularly adapted for food or other articles and includes a lid 11 hinged at the rear at 11*a* to a base 12. The lid 11 includes a central dome portion 13 having a horizontal flange 14 extending around the periphery thereof. The base 12 includes a central receptacle portion 15 having a horizontal flange 16 extending around the periphery thereof. The flange 14 on the lid 11 is provided with a depending rim 17 at the front of the lid opposite the hinge 11*a*. The rim 17 tapers from a maximum vertical dimension along the front end of the lid to a minimum along the sides as it approaches the hinge 11*a*. This is clearly shown in FIG. 1 of the drawing. The horizontal flange 14 on the lid 11 is adapted for engagement with the horizontal flange 16 on the base 12 when the container 10 is in closed condition, FIGS. 2, 3 and 4. The base flange 16 preferably is provided with cut-outs 16*c* at the corners adjacent the latching structures to aid in opening the container.

Figure 3:
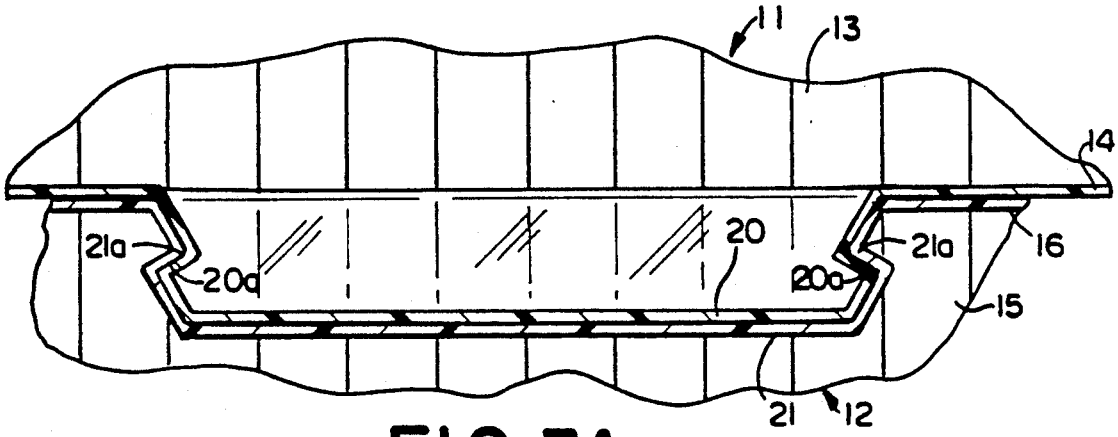
FIG. 3 is a sectional view taken along the lines 3—3 in FIG. 2 showing the container and latch in closed condition.
Figure 3A:
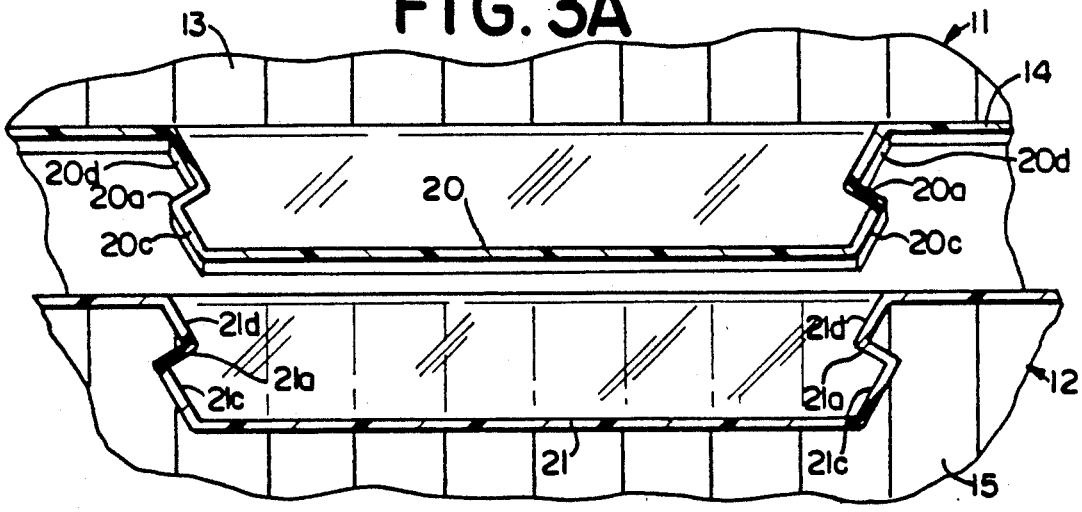
FIG. 3A is a sectional view similar to FIG. 3 showing the container and latch in open condition.

The container 10 shown in FIG. 1 is provided with latching structure for latching the lid 11 to the base 12 as now to be described. At least one substantially rectangular male rib 20 depends from the flange 14 at the front of the lid 11. At least one cooperating substantially rectangular female recess 21 is provided in the flange 16 at the front of the base 12. The male rib 20 is dimensioned slightly smaller than the cooperating female recess 21 so as to be received therein. As may be seen in FIGS. 3 and 3A the substantially rectangular male rib 20 has at its opposite ends outwardly extending shoulder structure 20*a*. Also as shown in FIG. 3A the opposite ends of the female recess 21 have inwardly extending shoulder structure 21*a* adapted to mate with the outwardly extending shoulder structure 20*a* on the male rib 20 of the lid 11 when the container 10 is in closed condition. This is illustrated in FIG. 3 of the drawing. The sides 20*b* of the substantially rectangular male rib 20 are substantially straight and vertical as are the sides 21*b* of the substantially rectangular female recess 21. This may clearly be seen in FIG. 4 of the drawing.

Figure 4A:
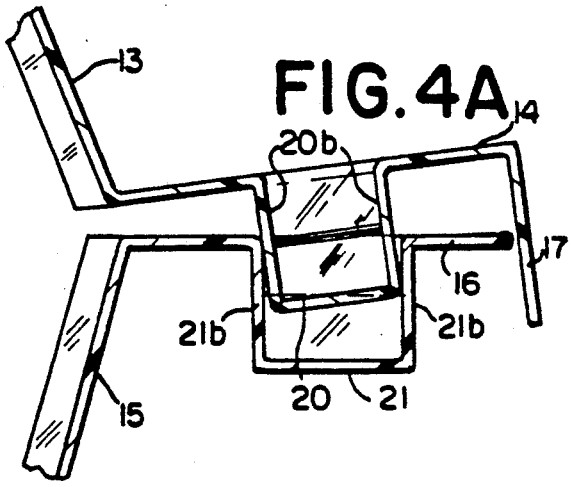
FIG. 4A is a sectional view similar to FIG. 4 showing the latch in partially open condition.
Figure 4:
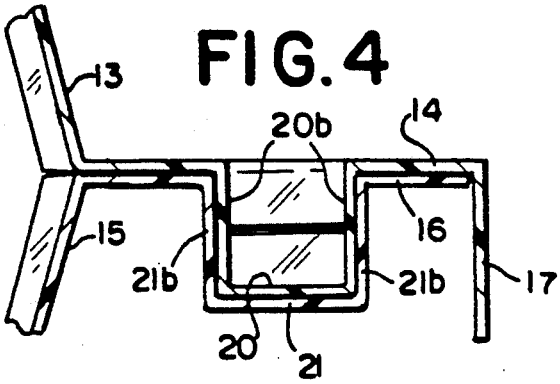
FIG. 4 is a sectional view taken along the lines 4—4 in FIG. 2 showing the latch in closed condition.

When the lid 11 of the container moves from the open condition in FIG. 3A to the closed condition of FIG. 3 the latching structure including the rib 20 moves from the position in FIG. 3A to the closed or latched position shown in FIG. 3. During this movement the cam surfaces 20*c* on the male rib 20 engage the inclined cam surfaces 21*d* on the female recess 21 causing the cam surface 21*d* to move outwardly and permit the shoulders 20*a* on the male rib 20 to move beneath the shoulders 21*a* on the female recess 21 thus bringing the surfaces 20*a* and 21*a* into engagement. Likewise, the mating surfaces 20*d* and 21*d* move into engagement and similarly the surfaces 20*c* and 21*c* move into engagement. This is clearly illustrated in FIG. 3. When the container 10 and latching structure are in closed condition as shown in FIGS. 3 and 4, the bottom of the rectangular male rib 20 will be close to engagement with the bottom of the rectangular female recess 21. The horizontal flange 14 on the lid 11 likewise will be in engagement with the horizontal flange 16 on the base 12 and will be held in engagement by the latching structure described above.

As shown in FIGS. 3 and 3A the opposite ends of the rectangular male rib 20 are both provided with the outwardly extending shoulder structure 20*a* and the opposite ends of the rectangular female recess 21 are both provided with the inwardly extending shoulder structure 21*a*. As may be seen in FIGS. 1, 2 and 4 the width of opposite ends of the male rib 20 and female recess 21 are relatively short as compared to the length of the sides of the rectangle. This permits the latching structure comprising the rectangular elements 20 and 21 to be relatively easily closed and opened to effect latching engagement and disengagement. However, by separating the opposite ends of the rectangular latching structure 20, 21 from each other, this provides for extended spacing of the latching structure along the front of the container 10. It will be appreciated that each end of the rectangular latching structure 20, 21 effects latching engagement with respect to the lid 11 and base 12. Since the width of the rectangular latching elements is small as compared to the length of the rectangular latching elements, this permits the latching structure to be placed in many locations on the flanges of the lid and base. This advantage also arises due to the fact that the latching structure is at the ends of the rectangular elements rather than along the sides thereof as in the prior art constructions. For example, see FIGS. 9–11A as hereinafter described. Similarly, these advantages are not present in an arrangement where the male and female latching elements are of cylindrical configuration.

Figure 5:
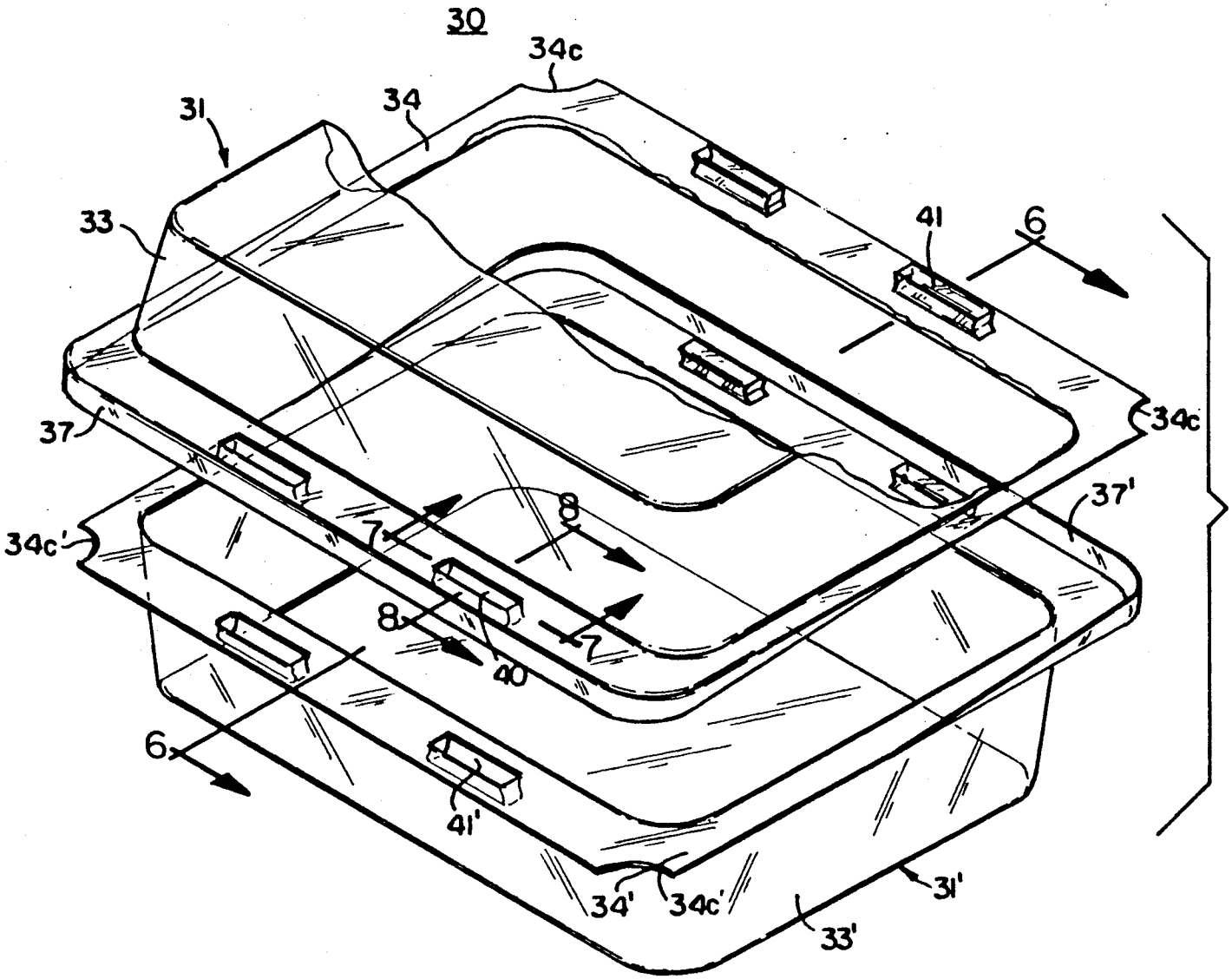
FIG. 5 is an exploded perspective view of another embodiment of the container of the present invention where the lid and base of the container are identical.
Figure 6:
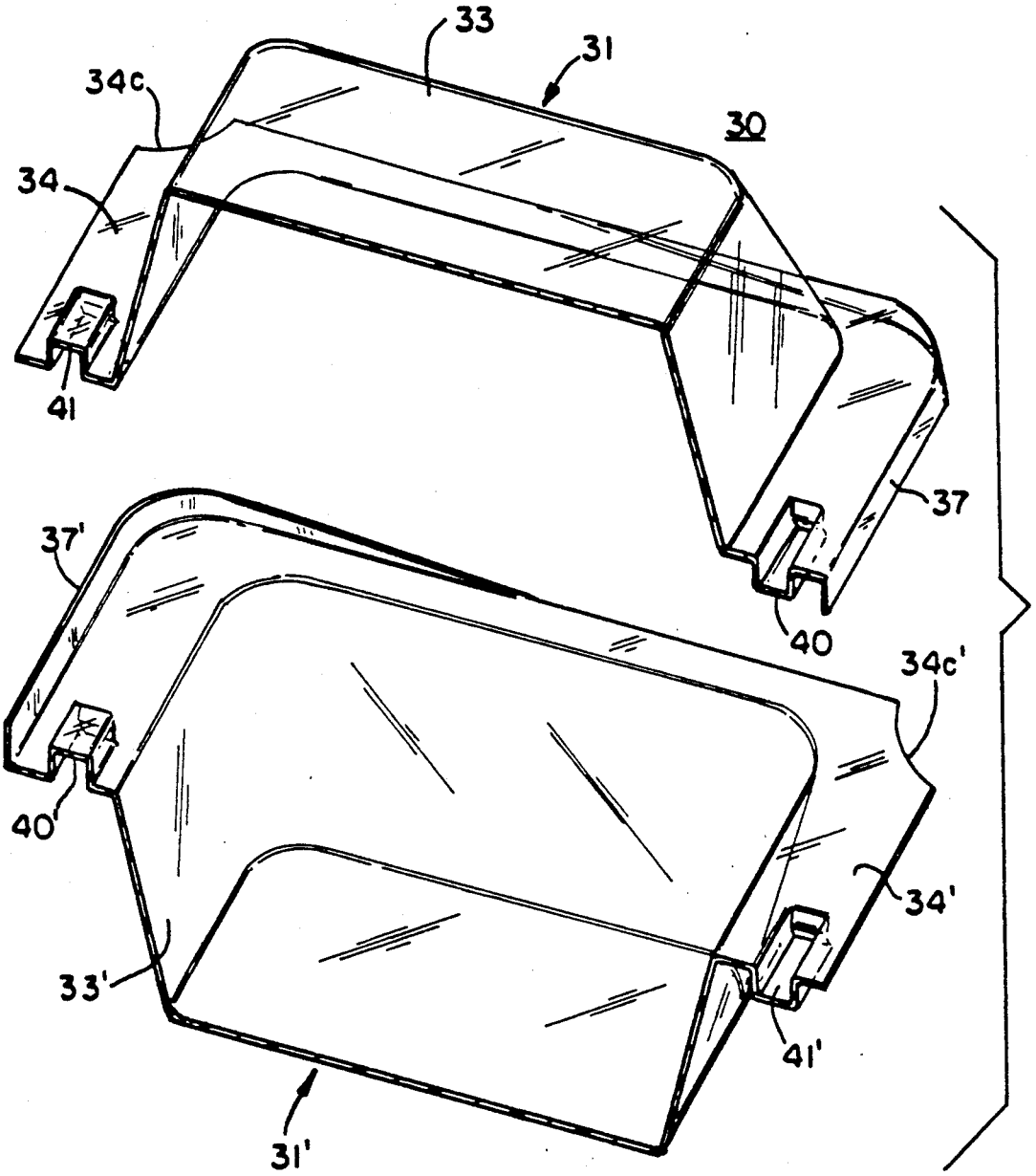
FIG. 6 is a sectional view taken along the lines 6—6 in FIG. 5.
Figure 7A:
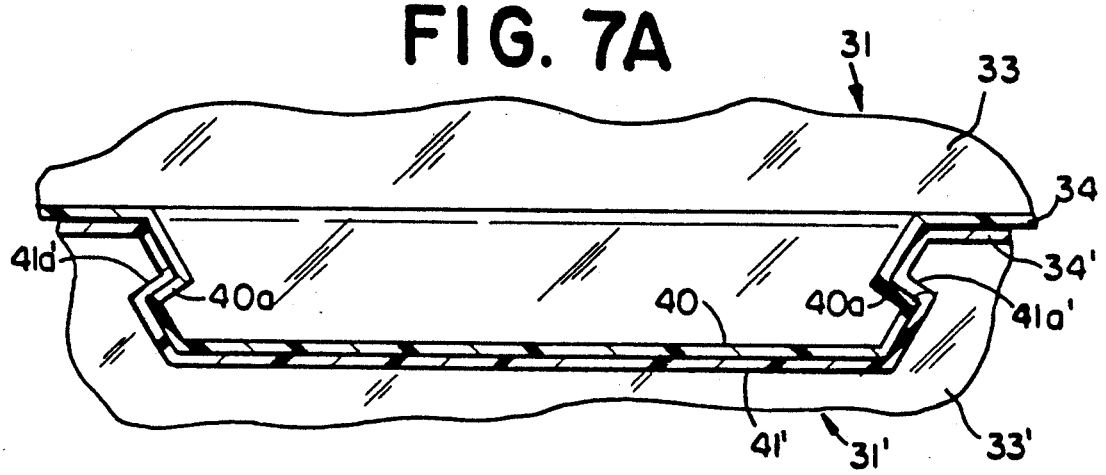
FIG. 7A is a sectional view similar to FIG. 7 showing the latch and container in closed condition.
Figure 7:
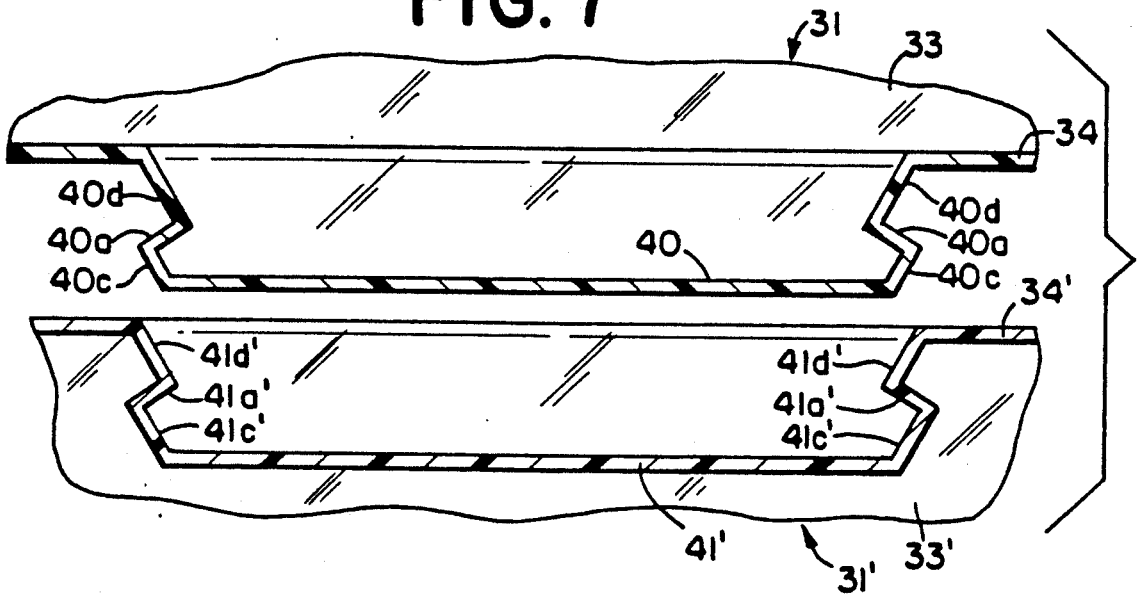
FIG. 7 is a sectional view taken along the lines 7—7 in FIG. 5 showing the container and latch in open condition.
Figure 8A:
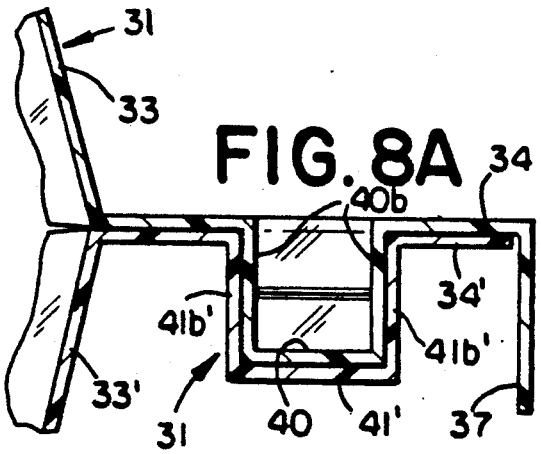
FIG. 8A is a sectional view similar to FIG. 8 showing the container and latch in closed condition.
Figure 8:
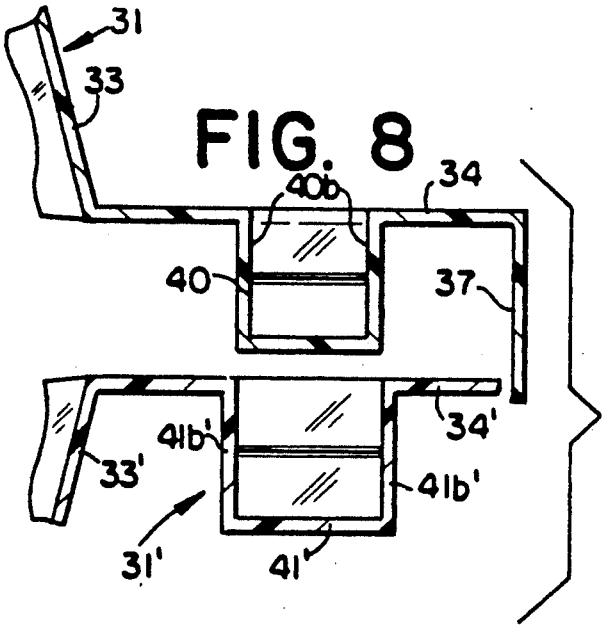
FIG. 8 is a sectional view taken along the lines 8—8 in FIG. 5 showing the container and latch in open condition.

Referring to FIGS. 5–8A there is disclosed another embodiment of the container of the present invention wherein the lid and base of the container are identical. In FIG. 5 there is illustrated a container 30 having a lid 31 and a base 31' of identical construction. To emphasize the identical construction the parts in the base will be identified with the same reference characters as the corresponding parts in the lid with the exception of the addition of a prime. It will be noted that the lid 31 and the base 31' are not hinged to each other as in the case of the embodiment previously illustrated in connection with FIGS. 1–4. The lid 31 includes a central dome portion 33 having a horizontal flange 34 extending around the periphery thereof. The flange 34 on the lid 31 is provided with a depending rim 37 at the front of the lid and cut-outs 34*c* at the rear of the lid. The rim 37 tapers from a maximum vertical dimension along the front end of the lid 31 to a minimum along the sides to the midpoint of each side. The base 31' includes a central receptacle portion 33' having a horizontal flange 34' extending around the periphery thereof. The flange 34' on the base 31' is provided with an upstanding rim 37' at the rear of the base and cut-outs 34*c'* at the front corners of the base. From FIGS. 5 and 6 it will be recognized that the base 31' is the same as the lid 31 when the latter is rotated about its longitudinal axis through an angle of 180°. The horizontal flange 34 on the lid 31 is adapted for engagement with the horizontal flange 34' on the base 31' when the container 30 is in closed condition as shown in FIGS. 7A and 8A. The cut-outs 34*c* and 34*c'* are provided to aid in opening the container latching structure.

The container 30 shown in FIGS. 5–8 is provided with latching structure for latching the lid 31 to the base 31' as now to be described. At least one substantially rectangular male rib 40 depends from the flange 34 at the front of the lid 31. At least one corresponding substantially rectangular female recess 41 is provided in the flange 34 at the rear of the lid 31. The base 31' has a corresponding rectangular male rib 40' and a corresponding rectangular female recess 41' in the rim 34'. The male ribs 40, 40' are dimensioned slightly smaller than the cooperating female recesses 41, 41' so as to be received therein. As may be seen in FIGS. 7 and 7A the substantially rectangular male rib 40 has at its opposite ends outwardly extending shoulder structure 40*a*. Also as shown in FIG. 7, the opposite ends of the female recess 41' have inwardly extending shoulder structure 41*a'* adapted to mate with the outwardly extending shoulder structure 40*a* on the male rib 40 of the lid 31 when the container 30 is in closed condition. This is illustrated in FIG. 7A of the drawing. The sides 40*b* of the rectangular male rib 40 are substantially straight and vertical as are the sides 41*b'* of the rectangular female recess 41'. This may clearly be seen in FIGS. 8 and 8A of the drawing.

When the lid 31 of the container 30 moves from the open condition in FIG. 7 to the closed condition of FIG. 7A the latching structure including the rib 40 moves from the position in FIG. 7 to the closed or latched position shown in FIG. 7A. During this movement the cam surfaces 40*c* on the opposite ends of the male rib 40 engage the inclined cam surfaces 41*d'* on the opposite ends of the female recess 41' causing the cam surfaces 41*d'* to move outwardly and permit the shoulders 40*a* on the male rib 40 to move beneath the shoulders 41*a'* on the female recess 41' thus bringing the surfaces 40*a* and 41*a'* into engagement. Likewise, the mating surfaces 40*d* and 41*d'* move into engagement as well as the surfaces 40*c* and 41*c'*. This is illustrated in FIG. 7A. When the container 30 and latching structure are in closed condition as shown in FIGS. 7A and 8A, the bottom of the rectangular male rib 40 will be in engagement with the bottom of the cooperating rectangular female recess 41'. The horizontal flange 34 on the lid 31 likewise will be in engagement with the horizontal flange 34' on the base 31'. As shown in FIGS. 5 and 6 the front and back of the container 30 are each provided with a pair of latching structures including the substantially rectangular male ribs 40, 40' and cooperating substantially rectangular female recesses 41' and 41. From the foregoing it will be seen that the latching structure for the container 30 disclosed in FIGS. 5–8A is similar to the latching structure for the container 10 shown in FIGS. 1–4A and provides the same advantages. The embodiment illustrated in FIGS. 5–8A has the additional advantage of requiring only one mold since the lid and base are identical. Thus both parts can be made on the same mold.

Figure 9:
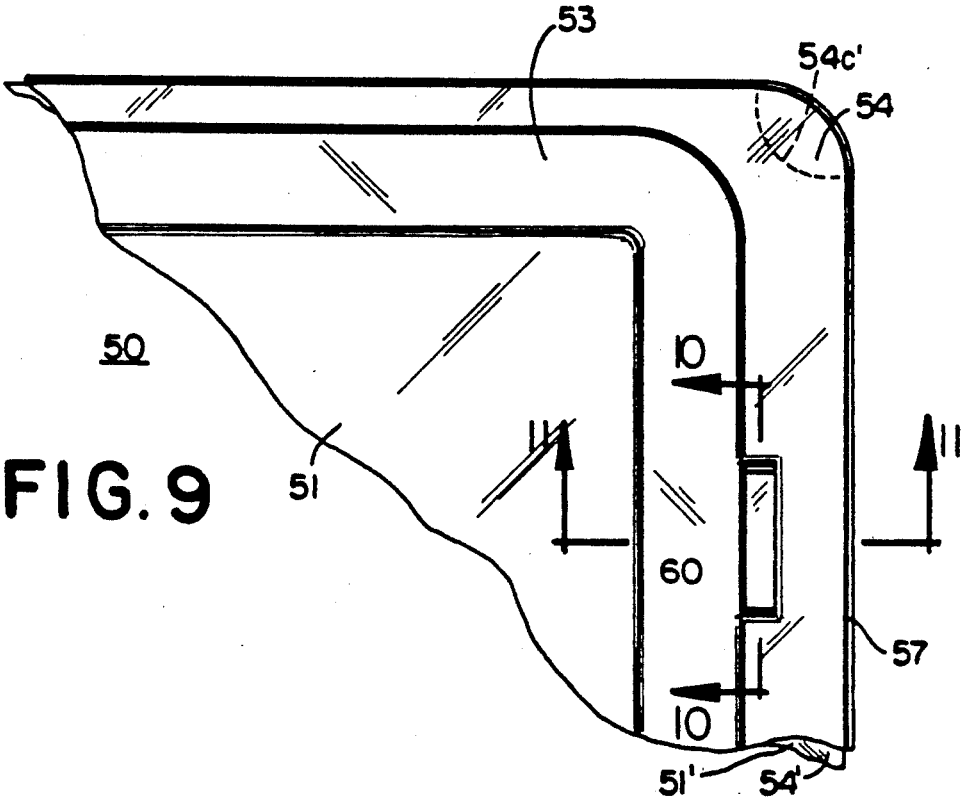
FIG. 9 is a fractional plan view of a modification of the invention similar to FIG. 2 showing the latching structure in a different location.
Figure 10:
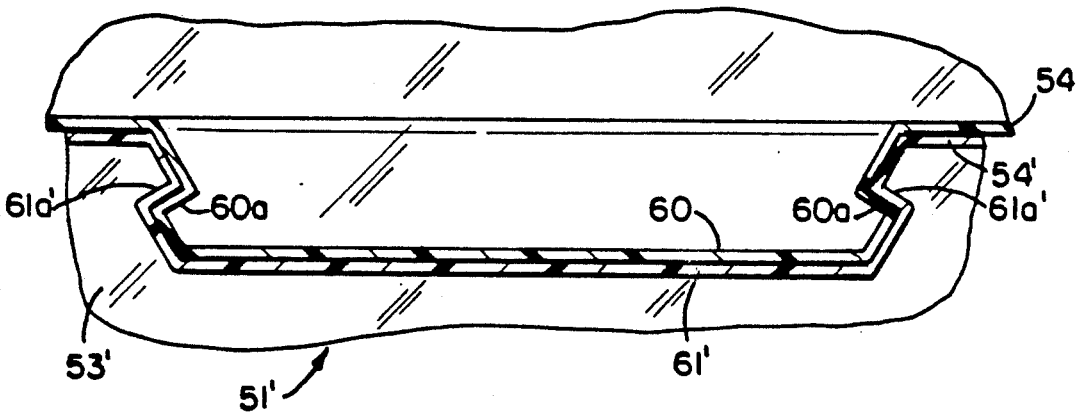
FIG. 10 is a sectional view taken along the lines 10—10 in FIG. 9 showing the container and latch in closed condition
Figure 11:
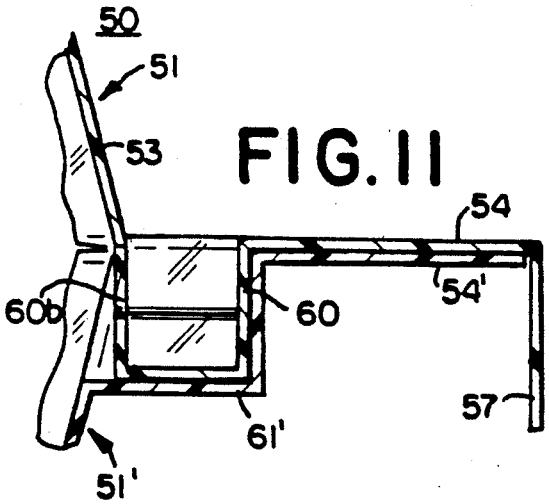
FIG. 11 is a sectional view taken along the lines 11—11 in FIG. 9 showing the container and latch in closed condition.
Figure 11A:
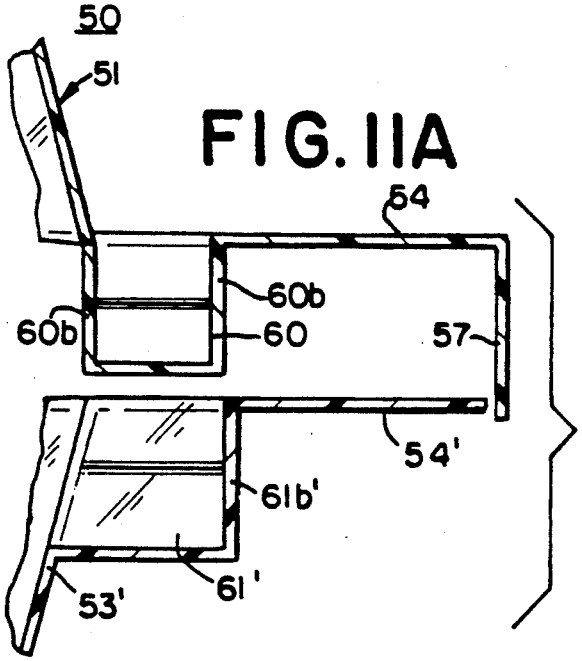
FIG. 11A is a sectional view similar to FIG. 11 showing the container and latch in open condition.

As pointed out above by using latching structure of the type disclosed in the present application it is possible to place the latching structure at various locations on the rim of the container. According to FIG. 9 there is illustrated a modification of the present invention wherein the container 50 is provided with latching structure having one side directly against the dome and receptacle portions of the container. The container 50 includes a lid 51 and a base 51' which may be hinged to the lid at the rear thereof similar to the embodiment illustrated in FIGS. 1–4 or the lid and base may be two identical parts as in the embodiment illustrated in FIGS. 5–8A. For purposes of explanation it will be assumed that the lid 51 and the base 51' are two identical parts similar to the embodiment of FIGS. 5–8A. As shown in FIG. 9 the lid 51 includes a central dome portion 53 having a horizontal flange 54 extending around the periphery thereof. The base 51' includes a central receptacle portion 53' having a horizontal flange 54' extending around the periphery thereof. The flange 54 on the lid 51 is provided with a depending rim 57 at the front of the lid. The rim 57 tapers from a maximum vertical dimension along the front end of the lid 51 to a minimum along the sides to the midpoint of each side as previously described in connection with the rim 37 on lid 31 in FIG. 5. The horizontal flange 54 on the lid 51 is adapted for engagement with the horizontal flange 54' on the base 51' when the container 50 is in closed condition as shown in FIGS. 10 and 11. The flange 54' is provided with a cut-out 54*c'*, FIG. 9, to aid in opening the container.

Figure 10A:
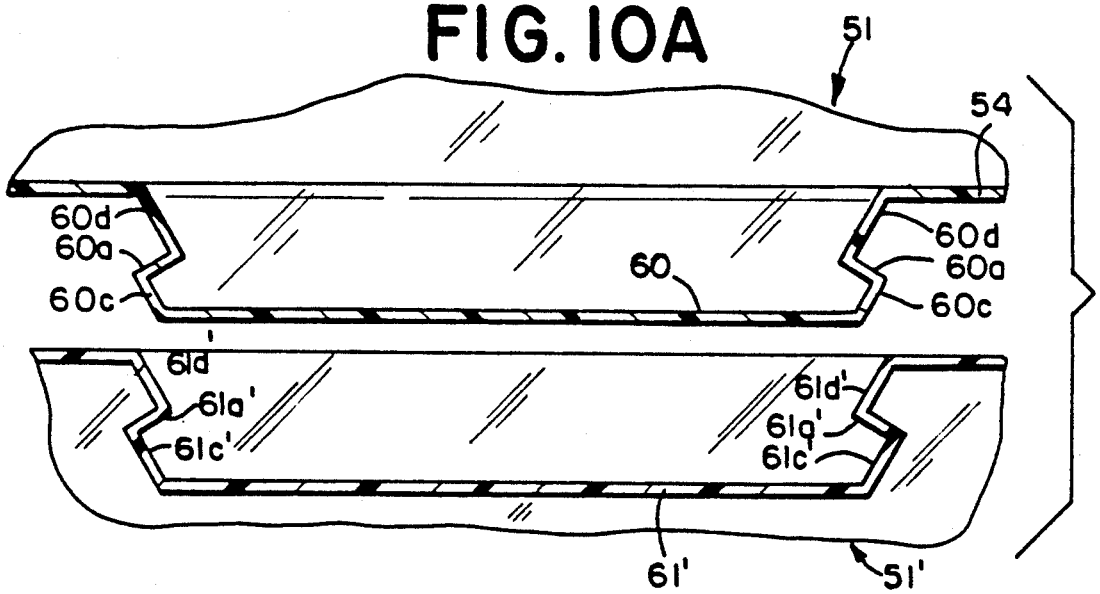
FIG. 10A is a sectional view similar to FIG. 10 showing the container and latch in open condition.

The container 50 shown in FIG. 9 would normally be provided with a pair of latching structures at the front end of the container and another pair at the back end of the container similar to the container 30 shown in FIG. 5. Since the latching structures are all identical it is believed only necessary to describe one of them and particularly the one shown in FIG. 9. As shown in FIG. 9, a substantially rectangular male rib 60 depends from the flange 54 at the front of the lid 51, FIGS. 9, 10 and 10A. At least one cooperating substantially rectangular female recess 61' is provided in the flange 54' at the front of the base 51'. the male rib 60 is dimensioned slightly smaller that the cooperating female recess 61' so as to be received therein. As may be seen in FIGS. 10 and 10A the substantially rectangular male rib 60 has at its opposite ends outwardly extending shoulder structure 60*a*. Also as shown in FIG. 10A the opposite ends of the female recess 61' have inwardly extending shoulder structure 61*a'* adapted to mate with the outwardly extending shoulder structure 60*a* on the male rib 60 of the lid 51 when the container 50 is in closed condition. This is illustrated in FIG. 10 of the drawing. The sides 60*b* of the substantially rectangular male rib 60 are substantially straight and vertical with respect to the rim 54. As may be seen in FIGS. 11 and 11A the inner side 60*b* of the rib 60 is located directly beneath the side wall of the dome 53. The cooperating rectangular female recess 61' is provided with only one side wall 61*b'* for ease in molding.

When the lid 51 of the container 50 moves from the open condition in FIG. 10A to the closed condition of FIG. 10 the latching structure including the rib 60 moves from the position in FIG. 10A to the closed or latched position shown in FIG. 10. During this movement the cam surfaces 60*c* on the opposite ends of the male rib 60 engage the inclined cam surfaces 61*d'* on the opposite ends of the female recess 61' causing the cam surfaces 61*d'* to move outwardly and permit the shoulders 60*a* on the male rib 60 to move beneath the shoulders 61*a'* on the female recess 61' thus bringing the surfaces 60*a* and 61*a'* into engagement. Likewise, the mating surfaces 60*d* and 61*d'* move into engagement as well as the surfaces 60*c* and 61*c'*. This is illustrated in FIG. 10. When the container 50 and latching structure are in closed condition as shown in FIGS. 10 and 11, the bottom of the rectangular male rib 60 will be in engagement with the bottom of the cooperating rectangular female recess 61'. The horizontal flange 54 on the lid 51 likewise will be in engagement with the horizontal flange 54' on the base 51'. Since the locking takes place at the ends of the rib 60 and the ends of the female recess 61' rather than along the sides of the ribs and recess, this permits the latching structure to be located at various locations on the rim of the container and particularly directly adjacent the dome 53 and receptacle portion 53'.

While there has been described a preferred embodiment of the invention, it will be understood that further modifications will be made without departing from the spirit and scope of the invention as set forth in the appended claims.

What is claimed:

1. A container for food or other articles comprising:

a lid having a horizontal flange extending around the periphery thereof, a base having a horizontal flange extending around the periphery thereof and adapted for engagement with the horizontal flange of said lid when said container is in closed condition, means for latching said lid to said base, said latching means including:

at least one substantially rectangular male rib depending from said horizontal flange of said lid, the opposite ends of said rib having outwardly extending shoulder structure, the sides of said rib being substantially straight, at least one substantially rectangular female recess in said flange of said base dimensioned to receive a cooperating said male rib in said lid, the opposite ends of said female recess having inwardly extending shoulder structure adapted to mate with said outwardly extending shoulder structure of said male rib in said lid, said sides of said female recess being substantially straight, said ends of said male rib and said ends of said female recess being constructed and arranged to deflect with respect to each other so that when said male rib is pressed into said female recess said shoulder structure on said male rib will snap into position beneath said shoulder structure in said female recess and interlock therewith to latch said lid to said base.

2. A container according to claim 1 wherein said lid is hinged to the rear of said base for movement towards and away from said base to open and close said container and said latching means is located at the front of said base.

3. A container according to claim 1 wherein said lid includes a central dome structure extending upwardly from said horizontal flange extending around the periphery thereof, and said base includes a central receptacle structure depending from said horizontal flange extending around the periphery thereof.

4. A container according to claim 1 wherein said first-named latching means is located on one side of said container, and second means for latching said lid to said base, said second latching means being located on the opposite side of said container from said first-named latching means and including:

at least one substantially rectangular male rib extending upwardly from said horizontal flange of said base, the opposite ends of said rib having outwardly extending shoulder structure, the sides of said rib being substantially straight, at least one substantially rectangular female recess in said flange of said lid dimensioned to receive a cooperating said male rib in said base, the opposite ends of said female recess having inwardly extending shoulder structure adapted to mate with said outwardly extending shoulder structure of said male rib in said base, said sides of said female recess being substantially straight, said ends of said male rib and said ends of said female recess being constructed and arranged to deflect with respect to each other so that when said male rib is pressed into said female recess, said shoulder structure on said male rib will snap into position above said shoulder structure in said female recess and interlock therewith to latch said lid to said base.

5. A container according to claim 4 wherein said lid includes a central dome structure extending upwardly from said horizontal flange extending around the periphery thereof, and said base includes a central receptacle structure depending from said horizontal flange extending around the periphery thereof and both said lid and said base are of identical construction and are interchangeable one with the other.

6. A container according to claim 1 wherein said horizontal flange of said lid includes a peripheral rim depending therefrom adjacent said male rib.

7. In a thermoformed plastic container for food or other articles including a lid having a horizontal flange on the periphery thereof and a base having a horizontal flange on the periphery thereof and adapted for engagement with the horizontal flange of the lid when the container is in closed condition, the improvement comprising means for latching said lid to said base, said latching means including:

at least one elongated male rib depending from said horizontal flange of said lid, the opposite ends of said rib having outwardly extending shoulder structure, said rib having at least one substantially straight side, at least one elongated female recess in said flange of said base dimensioned to receive a cooperating male rib in said lid, the opposite ends of said female recess having inwardly extending shoulder structure adapted to mate with said outwardly extending shoulder structure of said male rib in said lid, said female recess having at least one substantially straight side, said ends of said male rib and said ends of said female recess being constructed and arranged to deflect with respect to each other so that when said male rib is pressed into said female recess said shoulder structure on said male rib will snap into position beneath said shoulder structure in said female recess and interlock therewith to latch said lid to said base.

8. A container according to claim 7 wherein said lid is hinged to the rear of said base for movement towards and away from said base to open and close said container and said latching means is located at the front of said base.

9. A container according to claim 7 wherein said lid includes a central dome structure extending upwardly from said horizontal flange on said lid, and said base includes a central receptacle structure depending from said horizontal flange on said base.

10. A container according to claim 7 wherein said first-named latching means is located on one side of said container, and second means for latching said lid to said base, said second latching means being located on the opposite side of said container from said first-named latching means and including:

at least one elongated male rib extending upwardly from said horizontal flange of said base, the opposite ends of said rib having outwardly extending shoulder structure, said rib having at least one substantially straight side, at least one elongated female recess in said flange of said lid dimensioned to receive a cooperating said male rib in said base, the opposite ends of said female recess having inwardly extending shoulder structure adapted to mate with said outwardly extending shoulder structure of aid male rib in said base, said female recess having at least one substantially straight side, said ends of said male rib and said ends of said female recess being constructed and arranged to deflect with respect to each other so that when said male rib is pressed into said female recess, said shoulder structure on said male rib will snap into position above said shoulder structure in said female recess and interlock therewith to latch said lid to said base.

11. A container according to claim 10 wherein said lid includes a central dome structure extending upwardly from said horizontal flange on said lid, and said base includes a central receptacle structure depending from said horizontal flange on said base and both said lid and said base are of identical construction and are interchangeable one with the other.

12. A container according to claim 7 wherein said horizontal flange of said lid includes a peripheral rim depending therefrom adjacent said male rib.

* * * * *

UNITED STATES PATENT AND TRADEMARK OFFICE

CERTIFICATE OF CORRECTION

PATENT NO. : B1 5,046,659

DATED : February 22, 1994

INVENTOR(S) : Richard T. Warburton

It is certified that error appears in the above-indentified patent and that said Letters Patent is hereby corrected as shown below:

In claim 18, column 4, line 3 change "sale" to --said--.

Signed and Sealed this

Seventh Day of November, 1995

Bruce Lehman

*Attest:*

BRUCE LEHMAN

*Attesting Officer*

*Commissioner of Patents and Trademarks*

US005046659A

REEXAMINATION CERTIFICATE (2232nd)

United States Patent [19]

[11] B1 5,046,659

Warburton

[45] Certificate Issued Feb. 22, 1994

[54] LATCHING STRUCTURE FOR FOOD CONTAINER

[75] Inventor: Richard T. Warburton, Canandaigua, N.Y.

[73] Assignee: Mobil Oil Corporation, Fairfax, Va.

Reexamination Request:
No. 90/003,016, Mar. 22, 1993

Reexamination Certificate for:

| | |
|---|---|
| Patent No.: | 5,046,659 |
| Issued: | Sep. 10, 1991 |
| Appl. No.: | 611,576 |
| Filed: | Nov. 13, 1990 |

[51] Int. Cl.[5] ..... B65D 1/22

[52] U.S. Cl. ..... 229/2.5 R; 220/4.21; 220/4.23; 220/4.24; 220/339; 24/662

[58] Field of Search ..... 24/662; 220/4.23, 4.24, 220/4.21, 4.22, 4.1, 4.2, 4.3, 306, 315, 339, 352

[56] References Cited

U.S. PATENT DOCUMENTS

| | | | |
|---|---|---|---|
| 2,362,120 | 11/1944 | De Swart . | |
| 2,995,269 | 8/1961 | Pease . | |
| 2,999,611 | 9/1961 | Paulson . | |
| 3,010,552 | 11/1961 | Davidson . | |
| 3,511,433 | 5/1970 | Andrews et al. | 229/44 |
| 3,545,798 | 12/1970 | Swett | 24/662 X |
| 3,565,146 | 2/1971 | Arnolds | 150/0.5 |
| 4,576,330 | 3/1986 | Schepp | 229/44 |
| 5,169,014 | 12/1992 | Hexamer | 229/2.5 R X |
| 5,176,272 | 1/1993 | Ryan | 220/4.23 |

*Primary Examiner*—Allan N. Shoap

[57] ABSTRACT

Latching structure for thermoformed plastic containers for food and the like wherein the lid and base of the containers are each provided with mating male and female elongated elements where the locking takes place at the end of the elongated elements rather than along the sides of these elements.

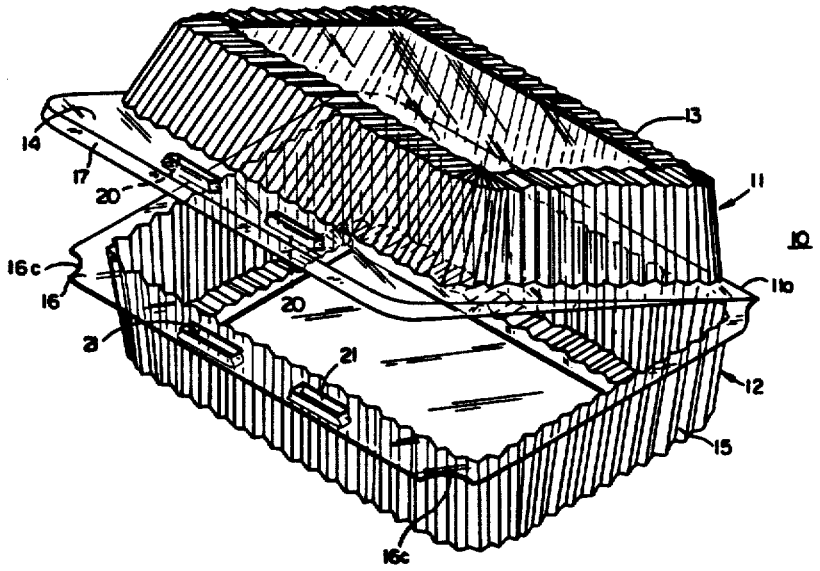

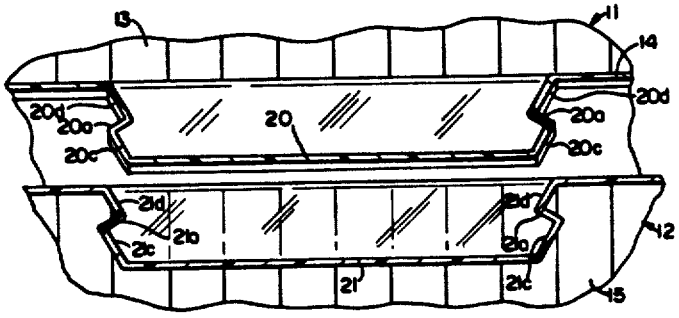

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-12 is confirmed.

New claims 13-19 are added and determined to be patentable.

*13. A container according to any one of the preceding claims wherein said ends of said male rib include cam surfaces positioned to engage inclined cam surfaces on said ends of said female recess to cause said inclined cam surfaces on said female recess to move outwardly and permit said shoulder structure on said male rib to move beneath said shoulder structure on said female recess and interlock therewith to latch said lid to said base.*

*14. A container for food or other articles comprising:*

*a lid having a horizontal flange extending around the periphery thereof,*

*a base having a horizontal flange extending around the periphery thereof and adapted for engagement with the horizontal flange of said lid when said container is in closed condition,*

*means for latching said lid to said base, said latching means including:*

*at least one substantially rectangular male rib depending from said horizontal flange of said lid, the opposite ends of said rib having outwardly extending shoulder structure, the sides of said rib being substantially straight,*

*at least one substantially rectangular female recess in said flange of said base dimensioned to receive a cooperating said male rib in said lid, the opposite ends of said female recess having inwardly extending shoulder structure adapted to mate with said outwardly extending shoulder structure of said male rib in said lid, said sides of said female recess being substantially straight, said ends of said male rib and said ends of said female recess being constructed and arranged to deflect with respect to each other so that when said male rib is pressed into said female recess said shoulder structure on said male rib will snap into position beneath said shoulder structure in said female recess and interlock therewith to latch said lid to said base, said cooperating male rib and female recess being in isolation from any other male rib or female recess of said latching means.*

*15. A container for food or other articles comprising:*

*a lid having a horizontal flange extending around the periphery thereof,*

*a base having a horizontal flange extending around the periphery thereof and adapted for engagement with the horizontal flange of said lid when said container is in closed condition,*

*means for latching said lid to said base, said latching means including:*

*at least one substantially rectangular male rib depending from said horizontal flange of said lid, the opposite ends of said rib having outwardly extending shoulder structure spaced from the top and bottom of said rib, the sides of said rib being substantially straight,*

*at least one substantially rectangular female recess in said flange of said base dimensioned to receive a cooperating said male rib in said lid, the opposite ends of said female recess having inwardly extending shoulder structure spaced from the top and bottom of said recess and adapted to mate with said outwardly extending shoulder structure of said male rib in said lid, said sides of said female recess being substantially straight, said ends of said male rib and said ends of said female recess being constructed and arranged to deflect with respect to each other so that when said male rib is pressed into said female recess said shoulder structure on said male rib will snap into position beneath said shoulder structure in said female recess and interlock therewith to latch said lid to said base.*

*16. A container according to claim 15 wherein said cooperating male rib and female recess are in isolation from any other male rib and female recess of said latching means.*

*17. In a thermoformed plastic container for food or other articles including a lid having a horizontal flange on the periphery thereof and a base having a horizontal flange on the periphery thereof and adapted for engagement with the horizontal flange of the lid when the container is in closed condition, the improvement comprising means for latching said lid to said base, said latching means including:*

*a least one elongated male rib depending from said horizontal flange of said lid, the opposite ends of said rib having outwardly extending shoulder structure, said rib having at least one substantially straight side,*

*at least one elongated female recess in said flange of said base dimensioned to receive a cooperating male rib in said lid, the opposite ends of said female recess having inwardly extending shoulder structure adapted to mate with said outwardly extending shoulder structure of said male rib in said lid, said female recess having at least one substantially straight side, said ends of said male rib and said ends of said female recess being constructed and arranged to deflect with respect to each other so that when said male rib is pressed into said female recess said shoulder structure on said male rib will snap into position beneath said shoulder structure in sale female recess and interlock therewith to latch said lid to said base, said cooperating male rib and female recess being in isolation from any other male rib or female recess of said latching means.*

*18. In a thermoformed plastic container for food or other articles including a lid having a horizontal flange on the periphery thereof and a base having a horizontal flange on the periphery thereof and adapted for engagement with the horizontal flange of the lid when the container is in closed condition, the improvement comprising means for latching said lid to said base, said latching means including:*

*a least one elongated male rib depending from said horizontal flange of said lid, the opposite ends of said rib having outwardly extending shoulder structure spaced from the top and bottom of said rib, said rib having at least one substantially straight side,*

*at least one elongated female recess in said flange of said base dimensioned to receive a cooperating male rib in*

*said lid, the opposite ends of said female recess having inwardly extending shoulder structure spaced from the top and bottom of said recess and adapted to mate with said outwardly extending shoulder structure of said male rib in said lid, said female recess having at least one substantially straight side, said ends of said male rib and said ends of said female recess being onstructed and arranged to deflect with respect to each other so that when said male rib is pressed into*

*said female recess said shoulder structure on said male rib will snap into position beneath said shoulder structure in sale female recess and interlock therewith to latch said lid to said base.*

*19. A container according to claim 18 wherein said cooperating male rib and female recess are in isolation from any other male rib and female recess of said latching means.*

* * * * *